US009776427B2

(12) United States Patent
Yamamura et al.

(10) Patent No.: US 9,776,427 B2
(45) Date of Patent: Oct. 3, 2017

(54) EXPOSURE DEVICE AND IMAGE FORMING APPARATUS

(71) Applicant: Oki Data Corporation, Tokyo (JP)

(72) Inventors: Akihiro Yamamura, Tokyo (JP); Eisuke Kuroki, Tokyo (JP)

(73) Assignee: Oki Data Corporation, Tokyo (JP)

( * ) Notice: Subject to any disclaimer, the term of this patent is extended or adjusted under 35 U.S.C. 154(b) by 0 days.

(21) Appl. No.: 15/160,354

(22) Filed: May 20, 2016

(65) Prior Publication Data

US 2016/0375699 A1 Dec. 29, 2016

(30) Foreign Application Priority Data

Jun. 25, 2015 (JP) ..... 2015-127273

(51) Int. Cl.
*B41J 2/45* (2006.01)
*G03G 15/04* (2006.01)

(52) U.S. Cl.
CPC ..... *B41J 2/45* (2013.01); *G03G 15/0409* (2013.01); *G03G 15/04054* (2013.01)

(58) Field of Classification Search
CPC .... B41J 2/451; B41J 2/45; G02B 7/00; G02B 7/008; G02B 7/02; G02B 7/021; G02B 7/023; G02B 7/025; G03G 15/04054; G03G 15/0409
USPC ..... 347/257, 258
See application file for complete search history.

(56) References Cited

U.S. PATENT DOCUMENTS

2003/0035667 A1* 2/2003 Izawa ..... G03G 15/2053 399/333
2011/0058877 A1* 3/2011 Sagawa ..... B41J 2/27 400/124.23
2012/0062686 A1* 3/2012 Suto ..... B41J 2/451 347/224

FOREIGN PATENT DOCUMENTS

JP 2012061666 A 3/2012

* cited by examiner

*Primary Examiner* — Huan Tran
*Assistant Examiner* — Alexander D Shenderov
(74) *Attorney, Agent, or Firm* — Muncy, Geissler, Olds & Lowe, P.C.

(57) ABSTRACT

An exposure device includes an optical system member that forms an image of light from a light emitting element array having multiple light emitting elements arranged, an optical system support part that supports the optical system member, and a restraining member that restrains the optical system member to the optical system support part. The optical system support part has sliding parts, which are able to slide relative to the restraining member, formed on a light emitting element side face and an image forming side face in positions opposing the both end parts or the vicinity of both end parts in a longitudinal direction of the optical system support part, and in the both end parts or in the vicinity of the both end parts in the longitudinal direction, the restraining member is formed between the sliding parts and the optical system member, fixed to the optical system member, and slidable in the longitudinal direction relative to the optical system support part.

19 Claims, 12 Drawing Sheets

EXPOSURE DEVICE AND IMAGE FORMING APPARATUS

CROSS REFERENCE TO RELATED APPLICATION

This application claims priority under 35 USC 119 to Japanese Patent Application No. 2015-127273 filed on Jun. 25, 2015, the entire contents which are incorporated herein by reference.

TECHNICAL FIELD

This invention relates to an exposure device and an image forming apparatus using it, and it especially relates to an exposure device configuration.

BACKGROUND

Conventionally, in an electrophotographic image forming apparatus that uses an LED head having multiple LEDs arranged in an array, an optical system that forms erect equal magnification images of an object in a line shape is used, and used in this optical system is, for example, a rod lens array where arranged are multiple rod lenses of a cylindrical shape having a refractive index that changes from the central axis toward the outside (for example, see Patent Document 1).

RELATED ART

[Patent Document 1] Unexamined Japanese Patent Application Publication 2012-61666 (Page 9, FIG. 6)

Because a rod lens array and a holder that holds it are long members and have different linear expansion coefficients, their size difference occurred between high temperature time and low temperature time, and cracks occurred to an adhesive bonding them at the ends of the holder, which reduced the adhesive force and made it difficult to maintain a sufficient holding powder.

SUMMARY

An exposure device, disclosed in the application, includes an optical system member that forms an image of light from a light emitting element array having multiple light emitting elements arranged, an optical system support part that supports the optical system member, and a restraining member that restrains the optical system member to the optical system support part. The optical system support part has sliding parts, which are able to slide relative to the restraining member, formed on a light emitting element side face and an image forming side face in positions opposing the both end parts or the vicinity of both end parts in a longitudinal direction of the optical system support part, and in the both end parts or in the vicinity of the both end parts in the longitudinal direction, the restraining member is formed between the sliding parts and the optical system member, fixed to the optical system member, and slidable in the longitudinal direction relative to the optical system support part.

Another exposure device, disclosed in the application includes an optical system member that forms an image of light from a light emitting element array in which multiple light emitting elements are arranged, an optical system support part that supports the optical system member, and a restraining member that restrains the optical system member to the optical system support part. The optical system member are provided with engagement parts extending in the longitudinal direction on both end parts or the vicinity of the both end parts in the longitudinal direction, and sliding parts that allow the engagement parts to slide relative to the restraining member in regions including the engagement parts, and in the both end parts or in the vicinity of the both end parts in the longitudinal direction, the restraining member is formed between the optical system support part and the engagement parts, is fixed to the optical system support part, and is slidable in the longitudinal direction relative to the optical system member.

According to this invention, it become possible to maintain the holding power of the optical system member by the optical system support part constantly stable even if the temperature environment changes.

BRIEF DESCRIPTION OF THE DRAWINGS

FIG. 6A is a cross-sectional view of a plane perpendicular to the longitudinal direction, FIG. 6B is a plan view, FIG. 6C is a side view, and FIG. 6D is a bottom view.

FIG. 7A is a cross-sectional view of a plane perpendicular to the longitudinal direction, FIG. 7B is a plan view, FIG. 7C is a side view, and FIG. 7D is a bottom view.

FIG. 9A is a cross-sectional view of the holder, and FIG. 9B is a plan view of the LED head.

DETAILED DESCRIPTION OF PREFERRED EMBODIMENTS

Embodiment 1

Figure 1:
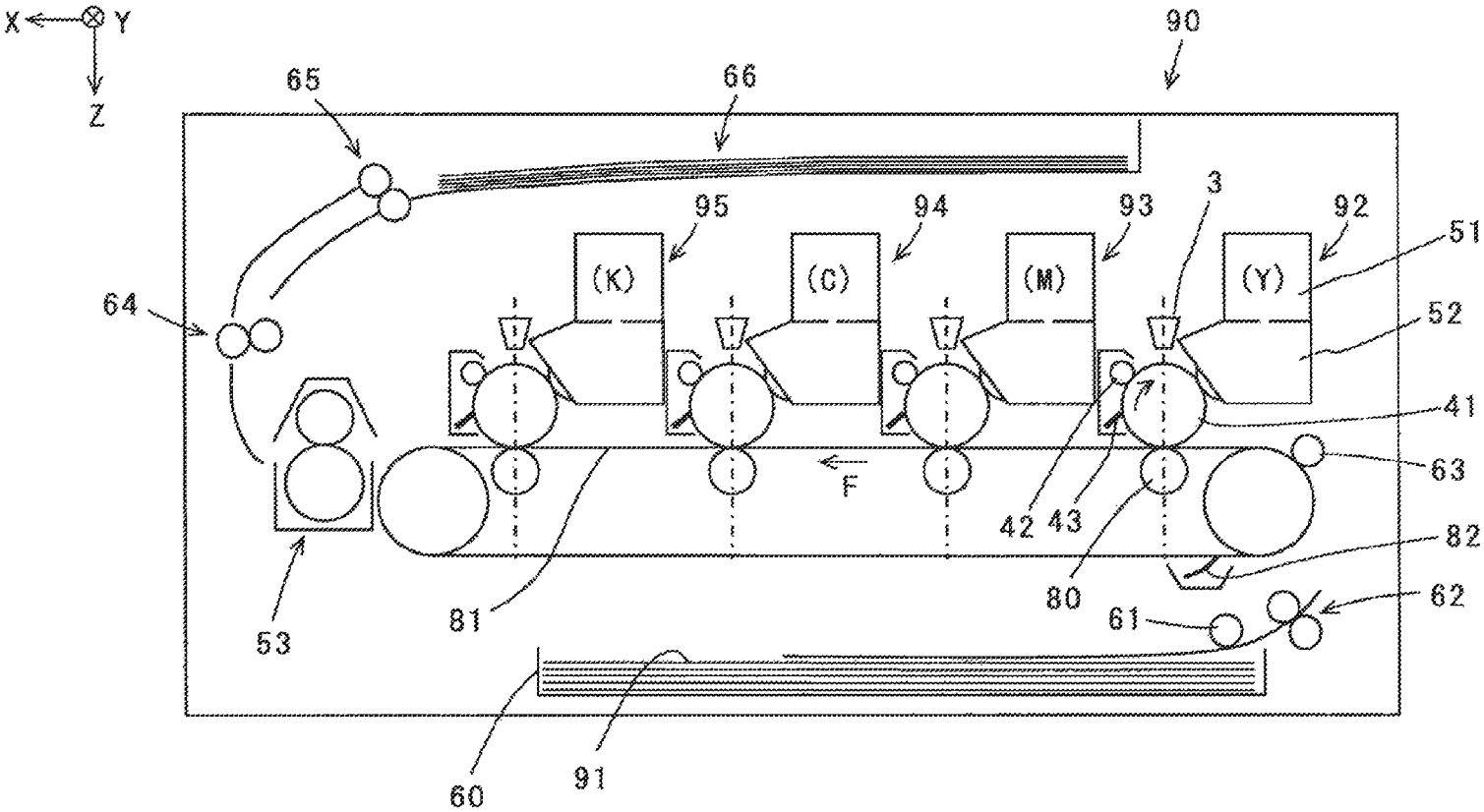
FIG. 1 is a main part configuration diagram showing the main part configuration of a color printer as an image forming apparatus of Embodiment 1 based on this invention.

FIG. 1 is a main part configuration diagram showing the main part configuration of a color printer as an image forming apparatus of Embodiment 1 based on this invention. A color printer 90 shown in the same figure is a color electrophotographic printer that forms an image on a print medium with toners made of resins containing pigments as color materials based on image data.

Inside the color printer 90, a sheet feeding cassette 60 that contains pieces of recording sheet 91 as a medium is attached, and a sheet feeding roller 61 that extracts the recording sheet 91 from the sheet feeding cassette 60, and carrying rollers 62 and 63 that carry the recording sheet 91 to image forming parts are disposed. Also, inside the color printer 90, as the image forming parts, toner image forming parts 92-95 that form toner images of individual colors of yellow (Y), magenta (M), cyan (C), and black (K) are disposed sequentially from the upstream side along the carrying path of the recording sheet 91 carried in the arrow F direction. These toner image forming parts 92-95 have the same configuration except that each of them uses a specified color toner.

For example, as shown in the toner image forming part 92 using the yellow (Y) toner, each toner image forming part is provided with a photosensitive drum 41 as an electrostatic latent image carrier that rotates in the arrow direction, a charging roller 42 that charges the photosensitive drum 41 by supplying a charge to its surface, an LED head 3 as an exposure device that forms an electrostatic latent image by selectively irradiating the charged surface of the photosensitive drum 41 with light based on the image data, a development device 52 that forms a toner image by developing the electrostatic latent image formed on the photosensitive drum 41 with the above-mentioned toner, a toner cartridge 51 that supplies the toner to the development device 52, and a cleaning blade 43 disposed in contact with the photosensitive drum 41 in order to remove the toner remaining on the surface of the photosensitive drum 41.

Also, disposed as a transfer part inside the color printer 90 are a transfer belt 81 that carries the recording sheet 91, transfer rollers 80 disposed opposing the respective photosensitive drums 41 so as to nip the transfer belt 81 for transferring onto the recording sheet 91 the toner images that are formed on the photosensitive drums 41 by visualizing the electrostatic latent image with the toners, and a cleaning blade 82 that cleans the transfer belt 81 by scraping off the toners adhering onto it. Then, disposed are a fuser device 53 that fuses the toner images formed on the recording sheet 91 by applying heat and a pressure, a carrying roller 64 that carries the recording sheet 91 that went through the fuser device 53, and an ejection roller 65 that ejects the recording sheet 91 to an ejection part 66 that retains the recording sheet 91 having the images fused.

Also, a specified voltage is applied to the charging roller 42 and the transfer roller 80 by an unshown power supply. Then, the transfer belt 81, the photosensitive drum 41, the sheet feeding roller 61, the carrying rollers 62-64, and the ejection roller 65 are each rotationally driven by unshown motors and unshown gears that transmit drive. Further, connected to the development device 52, the LED head 3, the fuser device 53, and the unshown motors are a power supply and a control device that are not shown.

Also, although the above-mentioned color printer 90 is provided with an external interface that communicates with an external device and receives print data, and a control part that receives print data from the external interface and controls the whole color printer 90, because they are not directly related with this invention, their detailed explanations are omitted.

Note that the directions of the arrow X, the arrow Y, and the arrow Z in FIG. 1 are defined so that the carrying direction when the recording sheet 91 passes through the toner image forming parts 92-95 is regarded as the arrow X direction, the rotation axis direction of the photosensitive drum 41 as the arrow Y direction, and the direction perpendicular to both of these directions as the arrow Z direction. Also, when the directions of the arrow X, the arrow Y, and the arrow Z are shown in other FIGS. 2-19 mentioned later, these directions are supposed to indicate the common directions. That is, the arrow X, Y, and Z directions in each figure indicate the disposition orientation of the part described in each figure in configuring the color printer 90 shown in FIG. 1. Also, here, the disposition is arranged so that the arrow Z direction becomes approximately the vertical direction, and the positive Z direction (arrow direction) is set downward in the vertical direction.

Figure 2:
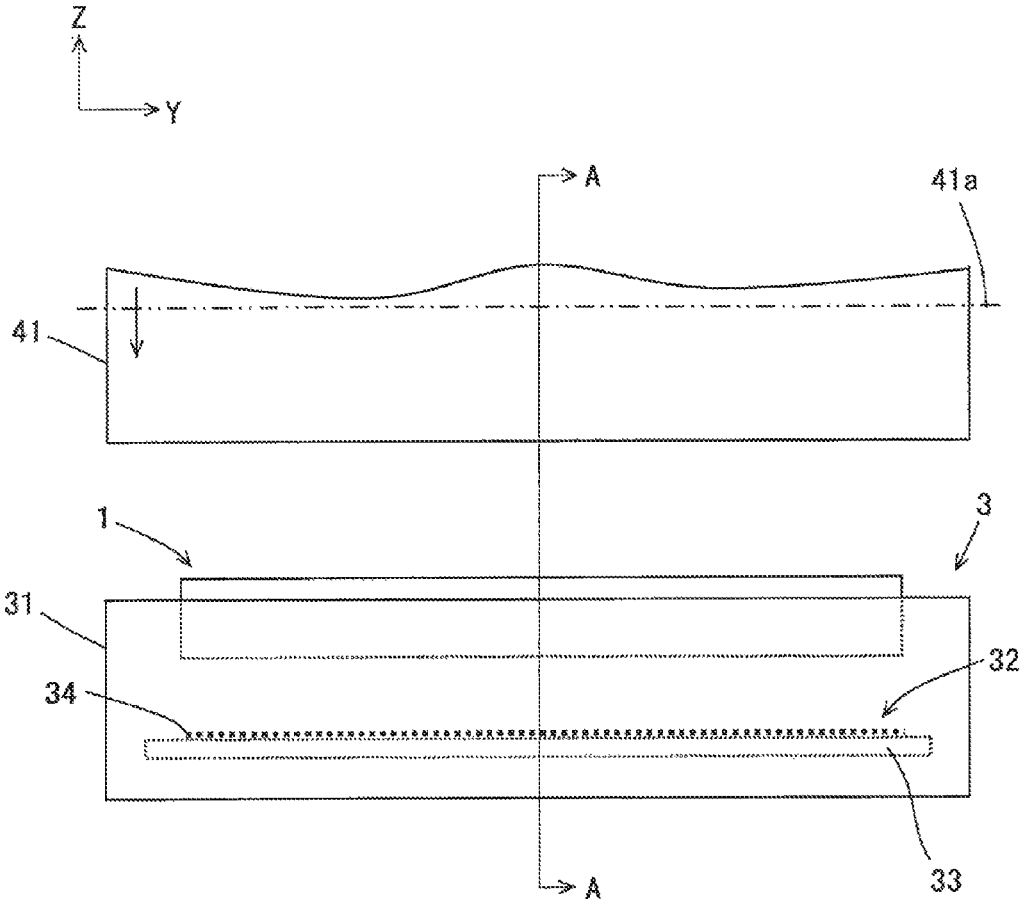
FIG. 2 is an outline configuration diagram where an LED head and a photosensitive drum are viewed from the positive side of the arrow X direction.

FIG. 2 is an outline configuration diagram of the LED head 3 and the photosensitive drum 41 as an exposure device viewed from the positive side of the arrow X direction, which is shown with up and down reversed from FIG. 1. In this case, the photosensitive drum 41 rotates in the direction of an arrow in the same figure.

The LED head 3 is provided with a lens array 1 as an optical system member, a holder 31 as an optical system support part, and an LED array 32 as a light emitting element array, where the holder 31 holds the lens array 1 and the LED array 32 in a specified positional relation mentioned later. LED elements 34 as light emitting elements are disposed in an approximate line on a substrate 33 to configure the LED array 32. The LED array 32 is held so that the array direction of the multiple LED elements 34 becomes the arrow Y direction (the rotation axis direction of the photosensitive drum 41), and the lens array 1 is also held so that its longitudinal direction becomes parallel to the LED array 32.

Therefore, the LED head 3 is disposed so that the array direction of the LED elements 34 of the LED array 32 and the longitudinal direction of the lens array 1 both become parallel to the rotation axis 41*a* of the photosensitive drum 41. As mentioned below, the lens array 1 has multiple rod lenses 46 (FIG. 4) disposed so that the optical axis of the lens array 1, that is the direction of incidence and emergence light beams of the rod lenses 46, becomes the arrow Z direction (vertical direction).

Figure 3:
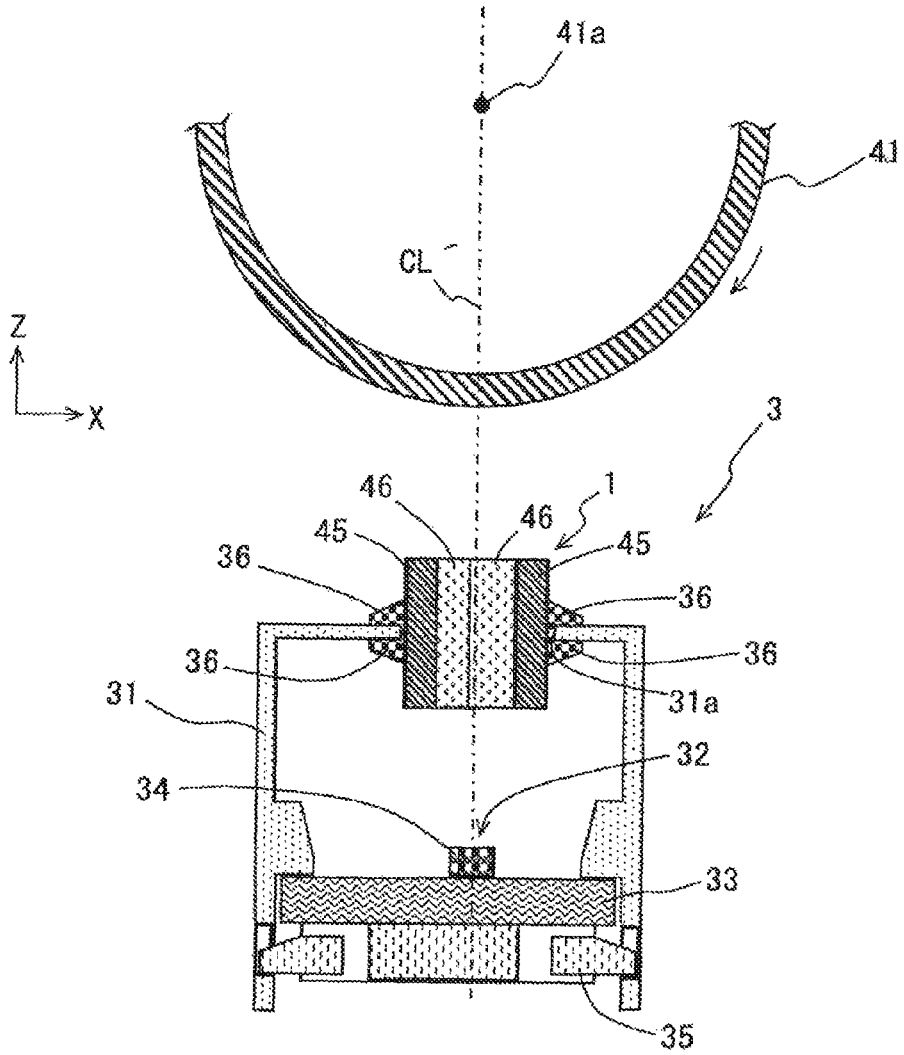
FIG. 3 is a cross-sectional view of A-A shown in FIG. 2.
Figure 4:
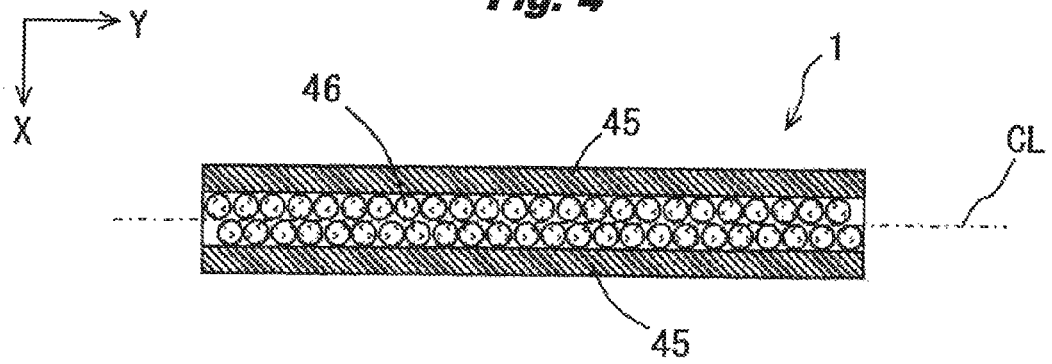
FIG. 4 is a plan view of a lens array.
Figure 5:
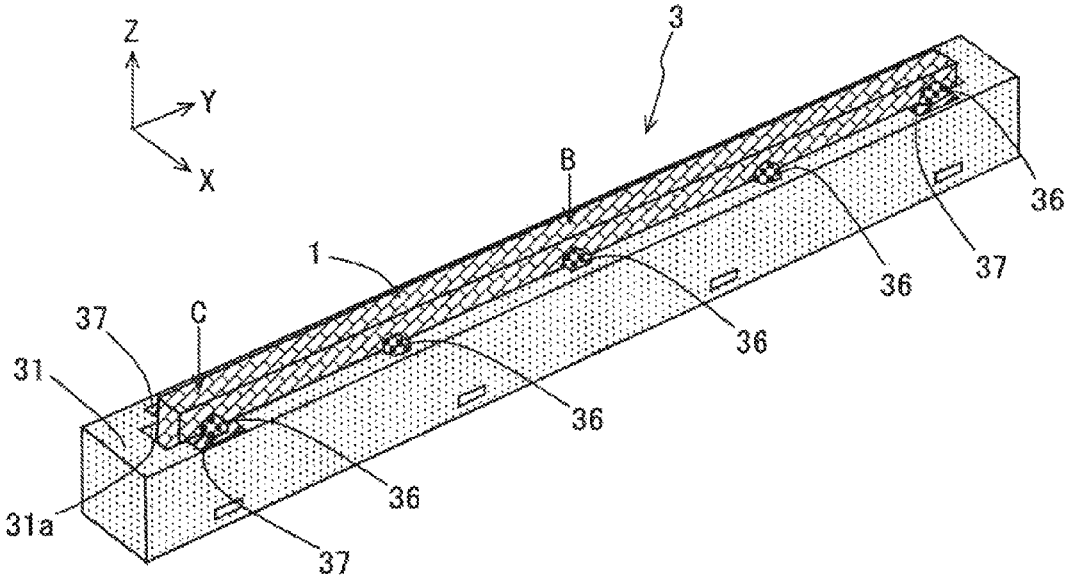
FIG. 5 is an external perspective view of an LED head in Embodiment 1.

FIG. 3 is a cross-sectional view of A-A shown in FIG. 2, FIG. 4 is a plan view of the lens array 1, and FIG. 5 is an external perspective view of the LED head 3. Referring to these figures, the configuration of the LED head 3 is further explained.

As shown in FIGS. 3 and 4, the lens array 1 comprises a pair of side plates 45 disposed opposing each other, and the multiple rod lenses 46 disposed between the pair of side plates 45. The multiple rod lenses 46 that are distributed-index lenses are disposed in two rows as shown in FIG. 4 and further disposed so that the rod lenses 46 in the different rows are positioned alternately in the longitudinal direction (arrow Y direction here). Also, spaces between the rod lenses 46 and spaces between the side plates 45 and the rod lenses 46 are formed by filling and curing an adhesive made of a silicon resin for example, and disposed so that the optical axes of the rod lenses 46 become the arrow Z direction (vertical direction).

In order to hold this lens array 1 opposing the photosensitive drum 41, the holder 31 is provided with an opening part 31*a* that is formed on is upper face, extends parallel to the longitudinal direction, and has the lens array 1 fit loosely with it, and holds the lens array 1 in a fitted-in state by gluing it in multiple gluing places with an adhesive 36 as the restraining members. The substrate 33 where the LED elements 34 are arranged is fixed to the holder 31 by a base member 35 so that the LED array 32 made of the LED elements 34 arranged in a line opposes the lens array 1 inside the holder 31.

In each of the gluing places, the adhesive 36 is applied to between the holder 31 and the side plates 45 of the lens array 1 as shown in FIG. 3. Specifically, the adhesive 36 is continuously applied to between the outer face of the holder 31 and the side plates 45, between the inner face opposing the outer face and the side plates 45, and spaces between the holder 31 and the side plates 45 in the opening part 31*a* that connect to the both places. Note that the sliding parts 37 shown in FIG. 5 are mentioned below.

At this time, for example, if the optical axis of the rod lenses 46 is disposed so as to become the arrow Z direction, denoting the center of the lens array 1 in the longitudinal direction (arrow Y direction) as CL, a relative alignment is performed so that the LED elements 34 arranged on the substrate 33 are positioned on a reference plane CL' that passes through CL and extends in parallel to the arrow Z direction, and further, the LED head 3 is aligned so that the rotation axis 41*a* of the photosensitive drum 41 is positioned on the reference plane CL'.

As shown in FIG. 3, the adhesive 36 is formed in pairs in opposing positions on both side parts of the lens array 1, and further as shown in FIG. 5, formed in five pairs here with approximately equal intervals in the longitudinal direction of the lens array 1. Among these, the glued positions in the vicinity of the both end parts in the longitudinal direction of the holder 31 are set to the vicinity of the ends of the lens array 1, here to positions at 10 mm from the ends of the lens array 1, and sliding parts 37 mentioned below are formed in these glued positions.

Note that in the lens array 1 here, its longitudinal size is set to 219 mm supposing an LED head mounted in an LED printer of the Letter paper size for example, and adopted as the material of the side plates 45 is a glass fiber epoxy resin laminated plate having a linear expansion coefficient of 14 ($10^{-6}$/° C.) for example. Also, adopted as the parent material for the material of the holder 31 here is an electrogalvanizd steel sheet having a linear expansion coefficient of 11.7 ($10^{-6}$/° C.) for example, and as the adhesive 36 is a UV-curable adhesive, for example, of the acrylate system having a glass filler or the like filled as its ingredient, elongation of 80%, and Shore D hardness of 60.

Figure 6B:
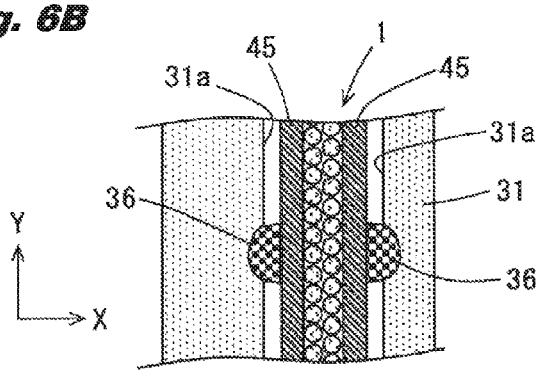
FIGS. 6A-6D are diagrams for explaining the configuration of a holder and a lens array in the vicinity of a position where sliding parts are not formed among the adhesive-applied places of the LED head in Embodiment 1, where
Figure 6C:
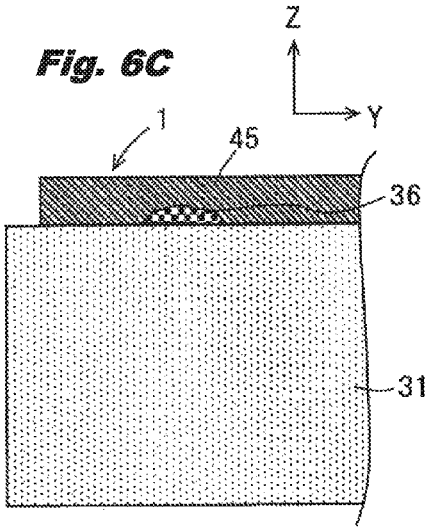
Figure 6A:
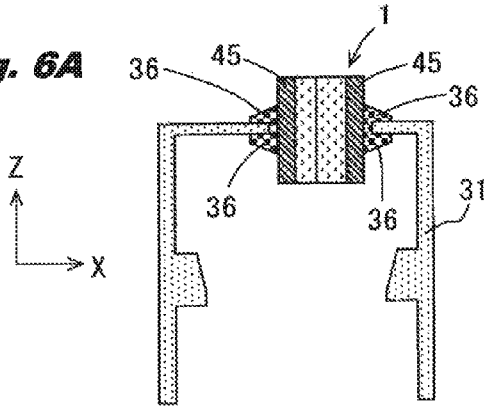
Figure 6D:
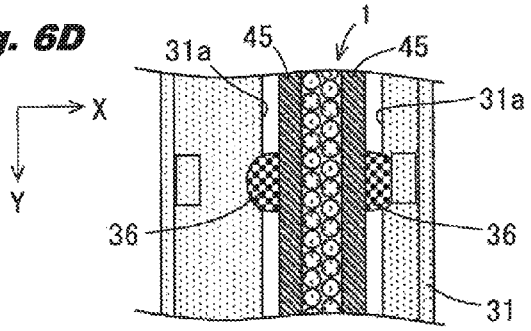

FIG. 6 is a diagram for explaining the configuration of the holder 31 and the lens array 1 in the vicinity of a position where the sliding parts 37 are not formed, for example, the glued position indicated by an arrow B in FIG. 5, among the adhesive 36 applied places of the LED head 3, where FIG. 6A is a cross-sectional view of a plane vertical to the longitudinal direction, FIG. 6B is a plan view, FIG. 6C is a side view, and FIG. 6D is a bottom view. Referring to FIG. 6, the configuration of the LED head 3 is further explained. Note that explanations here are given assuming a disposition where the longitudinal direction of the LED head 3 is parallel to the arrow Y direction, and the optical axis direction of the lens array 1 is parallel to the arrow Z direction.

As shown in these figures, the adhesive 36 is formed in a pair opposing each other in the arrow X direction so as to bridge between the side plates 45 and 45 of the lens array 1 and the holder 31 in this part, and the adhesive 36 is continuously applied to between the outer (upper) face of the holder 31 and the side plates 45, between the inner (lower) face opposing its outer face and the side plates 45, and spaces between the holder 31 and the side plates 45 in the opening part 31*a* that connect to the both places. That is, the adhesive 36 in this part is formed continuously on the upper face (arrow Z positive side face) of a flat plate part where the opening part 31*a* of the holder 31 is formed, on the lower face (arrow Z negative side face), and between the opening part 31*a* and the side plates 45 of the lens array 1.

Figure 7B:
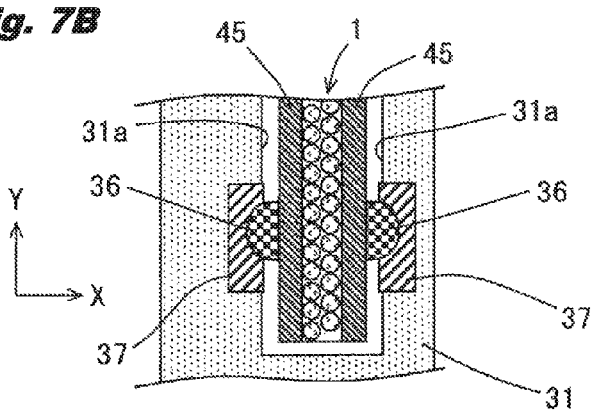
FIGS. 7A-7D are diagrams for explaining the configuration of a holder and a lens array in the vicinity of a position where sliding parts are formed among the adhesive-applied places of the LED head in Embodiment 1, where
Figure 7A:
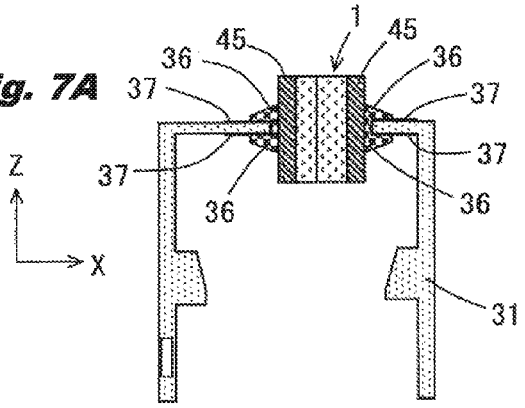
Figure 7C:
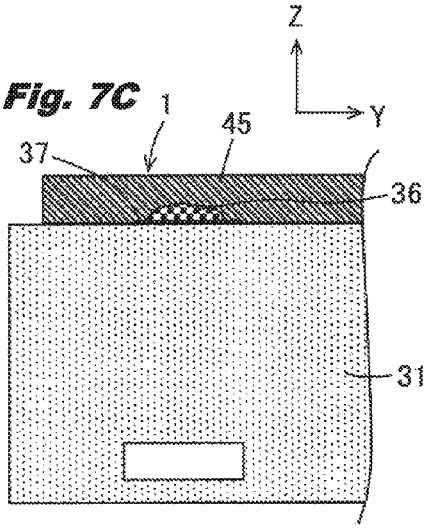
Figure 7D:
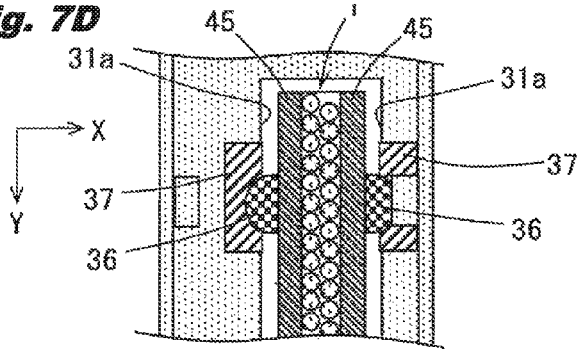

FIG. 7 is a diagram for explaining the configuration of the holder 31 and the lens array 1 in the vicinity of a position where the sliding parts 37 are formed, for example, the glued position indicated by an arrow C in FIG. 5, among the adhesive 36 applied places of the LED head 3, where FIG. 7A is a cross-sectional view of a plane perpendicular to the longitudinal direction, FIG. 7B is a plan view, FIG. 7C is a side view, and FIG. 7D is a bottom view.

Referring to FIG. 7, the configuration of the LED head 3 is further explained. Note that explanations here are given assuming a disposition where the longitudinal direction of the LED head 3 is parallel to the arrow Y direction, and the optical axis direction of the lens array 1 is parallel to the arrow Z direction.

As shown in these figures, in this part, the sliding parts 37 are formed on the surface of the holder 31 in a position where the applied adhesive 36 is on these sliding parts 37 in the holder 31 side as mentioned above, and further, over a wider area in the longitudinal direction at least than the formation region of the adhesive 36. That is, the adhesive 36 in this part is formed continuously on the upper face (arrow Z positive face) of the flat plate part where the opening part 31*a* of the holder 31 is formed, the lower face (arrow Z negative face), and between the sliding parts 37 and the side plates 45 of the lens array 1 arranged in the opening part 31*a*.

The sliding parts 37 were formed with poly-α-olefin (PAO) that is a polyolefin resin as its main ingredient, using lithium soap as a thickener, and applying a lubricating oil of high releasability with its lubricity adjusted by blending in polytetrafluoroethylene (PTFE) and perfluoroalkoxy resin (PFA).

Note that although here the sliding parts 37 were formed by applying a lubricating oil having PAO as its main ingredient, this invention is not limited to this, but a lubricating oil having silicone as its main ingredient may be applied, and also a fluorine-based lubricating oil having Palm fatty acid ester (PFA) as its main ingredient and PTFE blended in may be used. Also, a coating film of high releasability may be formed. The coating film can be formed, for example, by diluting PFA in hydrofluoroether (HFE), applying it to the sliding parts 37 and drying it. Also, the sliding parts 37 may be formed by pasting a film of high releasability. As the film of high releasability there are films of polyolefin resin, PTFE, and PFA. Also, a tape made by applying an adhesive material to a film of high releasability may be used. Further, a plated layer of high releasability may be formed on the sliding parts 37. Known as the plated layer of high releasability are hard chrome plating and hard chrome plating with PTFE, PFA, or the like blended in.

Because of such a manner of formation as mentioned above, the adhesive 36 applied to the sliding parts 37 comes into a state where its adhesive power to the contact faces of the sliding parts 37 is weakened when it is cured, the lens array 1 integrated with the adhesive 36 becomes slidable, even though it is tight, in its longitudinal direction guided by a part of the holder 31 where the sliding parts 37 are formed.

Also, although not shown here, it is preferable to apply a sealing agent such as silicon rubber having flexibility between the holder 31 and the lens array 1 so as to fill a space with the lens array 1 occurring in the opening part 31*a* and further cover the adhesive 36.

In the above configuration, first, the operation of the color printer 90 is explained referring to FIG. 1.

The surface of the photosensitive drum 41 of each of the toner image forming parts 92-95 is charged by the charging roller 42 to which a voltage is applied by an unshown power supply device. Subsequently, once the charged surface of the photosensitive drum 41 reaches the vicinity of the LED head 3 by the photosensitive drum 41 rotating in the arrow direction, it is exposed by the LED head 3, and an electrostatic latent image is formed on the surface of the photosensitive drum 41. This electrostatic latent image is developed by the development device 52 to form a toner image on the surface of the photosensitive drum 41.

On the other hand, the recording sheet 91 set in the sheet feeding cassette 60 is extracted by the sheet feeding roller 61 from the sheet feeding cassette 60 and carried by the carrying rollers 62 and 63 to the vicinity of the transfer roller 80 and the transfer belt 81. Then, once the toner image on the surface of the photosensitive drum 41 obtained by the development reaches the vicinity of the transfer roller 80 and the transfer belt 81 by the photosensitive drum 41 rotating, the toner image on the surface of the photosensitive drum 41 is transferred onto the recording sheet 91 by the transfer roller 80 and the transfer belt 81 to which a voltage is applied by an unshown power supply device.

The above-mentioned transfer of the toner image onto the recording sheet 91 is performed in the toner image forming parts 92-95 that form toner images of individual colors of yellow (Y), magenta (M), cyan (C), and black (K) sequentially superimposed on one another.

Subsequently, the recording sheet 91 with individual color toner images formed on its surface is carried to the fuser device 53 by the rotation of the transfer belt 81. The fuser 53 melts the toner images on the recording sheet 91 by applying heat while applying a pressure and fixes them onto the recording sheet 91. The recording sheet 91 with the fusing process performed is ejected to the ejection part 66 by the carrying roller 64 and the ejection roller 65, thereby an image forming operation is finished.

Next, the operation of the LED head 3 is explained referring to FIGS. 2 and 3. Once a control signal to the LED head 3 is sent by an unshown control part of the color printer 90 based on image data, the LED elements 34 of the LED array 32 selectively emit light. Light beams from the LED array 32 enter the lens array 1 and form an image on the photosensitive drum 41.

Next, explained are a temperature test performed with multiple kinds of the LED heads 3 provided with the sliding parts 37 prepared as the experimental samples and the result.

Note that the test was performed under the following test conditions. (1) The LED heads prepared as the test samples are four LED heads in total: two LED heads 3 of Embodiments 1 and 2 provided with the sliding parts 37 based on this invention and two LED heads of Comparative Examples 1 and 2 not provided with the sliding parts 37 prepared as comparative reference examples. (2) The configuration of the LED heads 3 of Embodiments 1 and 2 is the configuration explained in FIG. 5 provided with the sliding parts 37, and the configuration of the LED heads of Comparative Examples 1 and 2 is the configuration where the sliding parts 37 are removed from it, and the adhesive 36 is directly applied to the holder 31 as explained in FIG. 6. (3) The longitudinal size of the lens array 1 of each LED head is 219 mm supposing an LED head mounted in an LED printer of the Letter paper size. (4) The holder 31 of each LED head is configured of an electrogalvanizd steel sheet having a linear expansion coefficient of 11.7 ($10^{-6}$/° C.) as the parent material. (5) The adhesive 36 of each LED head is a UV-curable adhesive, and an acrylate system adhesive with a glass filler or the like filled as its ingredient was used. This adhesive 36 has elongation of 80% and Shore D hardness of 60. (6) The side plates 45 of the lens array 1 of each LED head of Embodiment 1 and Comparative Example 1 are configured of glass fiber epoxy resin laminated plates having a linear expansion coefficient of 14 ($10^{-6}$/° C.), the side plates 45 of the lens array 1 of each LED head of Embodiment 2 and Comparative Example 2 are configured of paper base phenolic resin laminated plates having a linear expansion coefficient of 18 ($10^{-6}$/° C.). (7) Test method: LED heads of Embodiments 1 and 2, and Comparative Examples 1 and 2 were thrown into a thermostatic bath, temperature of the thermostatic bath was changed, and after specified time passed, the presence of cracks on the adhesive 36 was checked. Further, the vicinity of the adhesive 36 of the lens array 1 was pressed with a finger in the optical axis direction toward the place where the LED elements 30 were disposed and toward the image forming direction to check whether the lens array 1 moved in the optical axis direction. The settings of the thermostatic bath temperature and time were that the temperature inside the thermostatic bath was [1] raised from −30° C. to +60° C. taking 1 hour, [2] maintained at +60° C. for 1 hour, [3] lowered from +60° C. to −30° C. taking 1 hour, and [4] maintained at −30° C. for 1 hour. Regarding [1] through [4] as one cycle, after repeating 100 cycles, the evaluation of the adhesive 36 was performed.

The test and evaluation result are explained referring to Table 1.

TABLE 1

| | Lens Array 1 | | | Condition of Adhesive 36 With or Without Crack | |
|---|---|---|---|---|---|
| | Configuration | Linear Expansion Coefficient | Sliding Part Configuration | Central Part (Places other than ends) | End Parts |
| Embodiment 1 | Glass Fiber Epoxy Resin | 14 ($10^{-4}$/° C.) | With | Fine | Fine |

TABLE 1-continued

| | Lens Array 1 | | | Condition of Adhesive 36 With or Without Crack | |
|---|---|---|---|---|---|
| | Configuration | Linear Expansion Coefficient | Sliding Part Configuration | Central Part (Places other than ends) | End Parts |
| Embodiment 2 | Paper Base Phenolic Resin | 18 ($10^{-4}$/° C.) | With | Fine | Fine |
| Example 1 | Glass Fiber Epoxy Resin | 14 ($10^{-4}$/° C.) | Without | Fine | Failure |
| Example 2 | Paper Base Phenolic Resin | 18 ($10^{-4}$/° C.) | Without | Fine | Failure |

As for the LED heads 3 of Embodiments 1 and 2 provided with the sliding parts 37 based on this invention, the adhesive 36 showed no cracks and was in a fine condition on the central part (places other than the ends) and either ends of the holder 31, and even when the lens array 1 was pressed down with a finger, it did not move. On the other hand, as for the LED heads of Comparative Examples 1 and 2, the adhesive 36 developed cracks and came into a failure condition on the ends of the holder 31, and when the lens array 1 in that part, the lens array 1 moved.

As stated above, according to the LED head 3 of this embodiment, even when the lens array 1 is fixed by the adhesive 36 to the holder 31 having a different linear expansion coefficient, because provided are the sliding parts 37 where the adhesive 36 is slidable in the longitudinal direction, the occurrence of cracks to the adhesive 36 due to temperature changes is prevented, thereby the lens array 1 can be prevented from displacing in any other direction than in the longitudinal direction.

Embodiment 2

Figure 8:
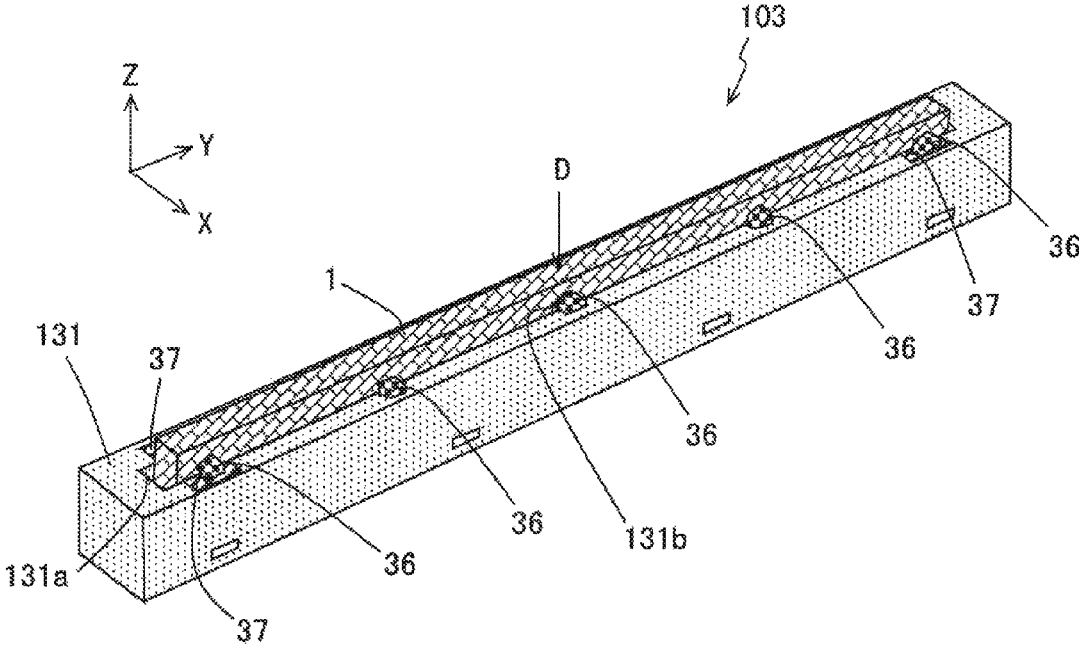
FIG. 8 is an external perspective view of an LED head in Embodiment 2.
Figure 9A:
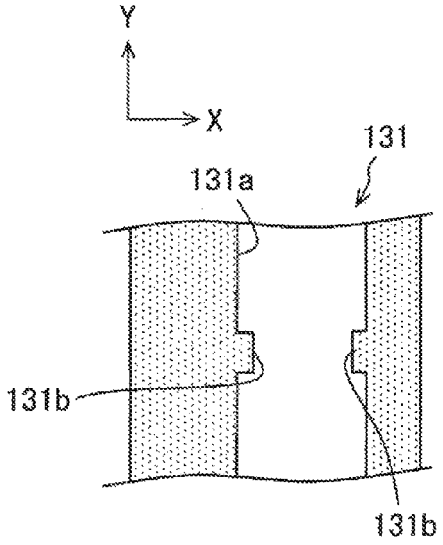
FIGS. 9A and 9B are diagrams for explaining the configuration of a holder and a lens array in the vicinity of the central position in the longitudinal direction among the adhesive-applied places of the LED head in Embodiment 2, where
Figure 9B:
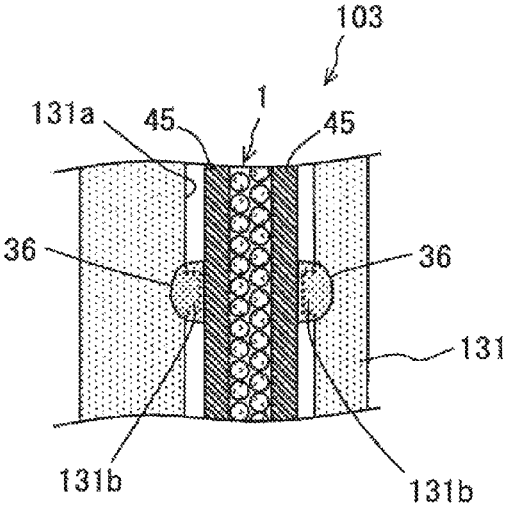

FIG. 8 is an external perspective view showing the configuration of an LED head 103 of Embodiment 2 based on this invention. Shown in FIG. 9 are diagrams for explaining the configuration of a holder 131 and a lens array 1 in the vicinity of the central position in the longitudinal direction, for example, a glued position indicated with an arrow D in FIG. 8, among adhesive 36 applied places of the LED head 103, where FIG. 9A is a plan view of the holder 131, and FIG. 9B is a plan view of the LED head 103.

The difference of an image forming apparatus of this embodiment adopting this LED head 103 from the above-mentioned color printer 90 (FIG. 1) of Embodiment 1 is the configuration of the holder 131 in the LED head 103. Therefore, the parts that the image forming apparatus adopting this LED head 103 has in common with the above-mentioned color printer 90 (FIG. 1) of Embodiment 1 are given the same codes, or the figures and explanations are omitted, and the differences are mainly explained. Note that because the main part configuration of the image forming apparatus of this embodiment is common with the main part configuration of the color printer 90 of Embodiment 1 shown in FIG. 1, except for the configuration of the LED head 103, figures in Embodiment 1 are referred to as necessary.

As shown in FIGS. 8 and 9, a pair of lock parts 131*b* protruding toward the direction of approaching each other from both side faces are formed in an opening part 131*a* of the holder 131, where the lens array 1 fits in, in the position that corresponds to the central adhesive 36 among five pairs of the adhesive 36 formed in the longitudinal direction (arrow Y direction) of the lens array 1 and approximately corresponds to the center of the lens array 1 in the longitudinal direction.

Note that although an example of the lock parts 131*b* that protrude in a rectangular shape is shown here, they only need to have a form that protrudes from the side face of the opening part 131*a* formed extending in parallel to the longitudinal direction by being provided with a face oblique to the longitudinal direction for example.

As shown in FIG. 9B, this pair of lock parts 131*b* are formed approaching the side plates 45 from both sides of the lens array 1 fitting in, and the adhesive 36 is further formed so as to cover the lock parts 131*b*. Its forming method is the same as the forming method of the adhesive in the other glued positions, and as explained in Embodiment 1, the adhesive 36 is continuously applied to between the outer (upper) face of the holder 131 and the side plates 45 of the lens array1, between the inner (lower) face opposing its outer face and the side plates 45, and spaces between the holder 131 and the side plates 45 in the opening part 131*a* that connect to the both places.

By forming in the above-mentioned manner, the adhesive power between the holder 131 and the lens array 1 increases in the central part of its longitudinal direction where the lock parts 131*b* are formed, enhancing the holding power of the lens array 1 by the holder 131, especially the holding power in the longitudinal direction.

The adhesive power increasing method in the central part of the longitudinal direction of the lens array 1 is not limited to the above-mentioned method, but the holder 131 may be provided with cuts in a direction away from the lens array 1 for example. Also, openings may be formed on the holder 131. Further, recess-projection parts extending in the optical axis direction of the lens array 1 may be formed on the holder 131, and the surfaces of the holder 131 may be roughened. In either case, the adhesive 36 that cured covering and filling the lock parts 131*b* formed with the cuts, the opening parts, or the recess-projection parts is securely fixed to the holder 131 in the longitudinal direction at least.

Further, although in this embodiment the sliding parts 37 were formed only in the glued positions on both end parts among the five pairs of the adhesive 36 formed in the longitudinal direction (arrow Y direction) of the lens array 1, this invention is not limited to this, but it may be configured so that the sliding parts 37 are formed in other positions than the central glued positions where the lock parts 131*b* are formed.

As stated above, according to the LED head 103 of this embodiment, other than obtaining the same effects as in Embodiment 1 mentioned above, because the lens array 1 is firmly held by the holder 131 on the central part in the longitudinal direction, the lens array 1 as the whole never moves in the longitudinal direction relative to the holder 131. Therefore, accuracy as the LED head 103 would never be lost due to environmental changes, passing of time, or the like.

Embodiment 3

Figure 10:
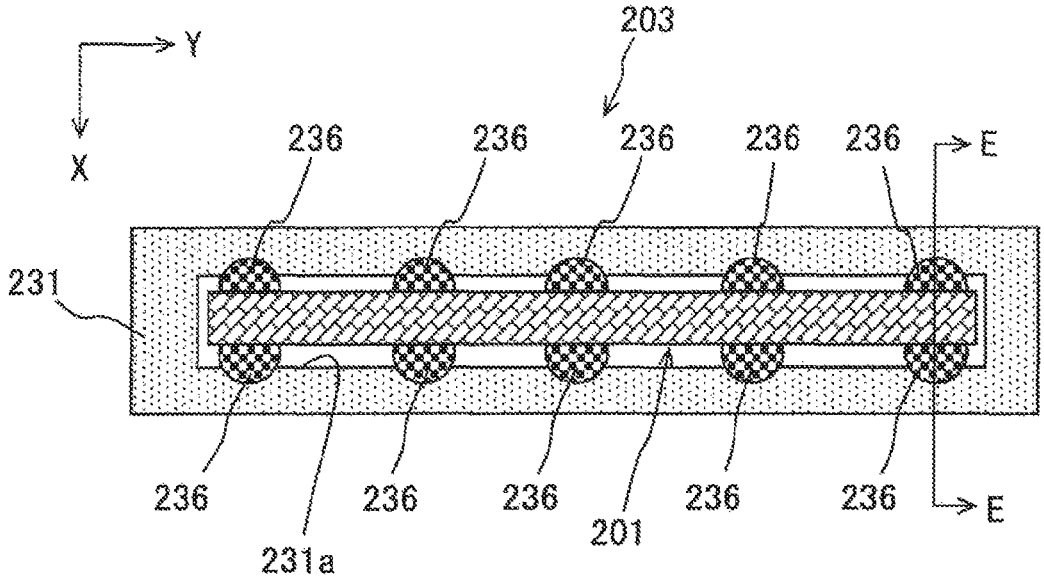
FIG. 10 is a plan view showing the configuration of an LED head of Embodiment 3 based on this invention.
Figure 11:
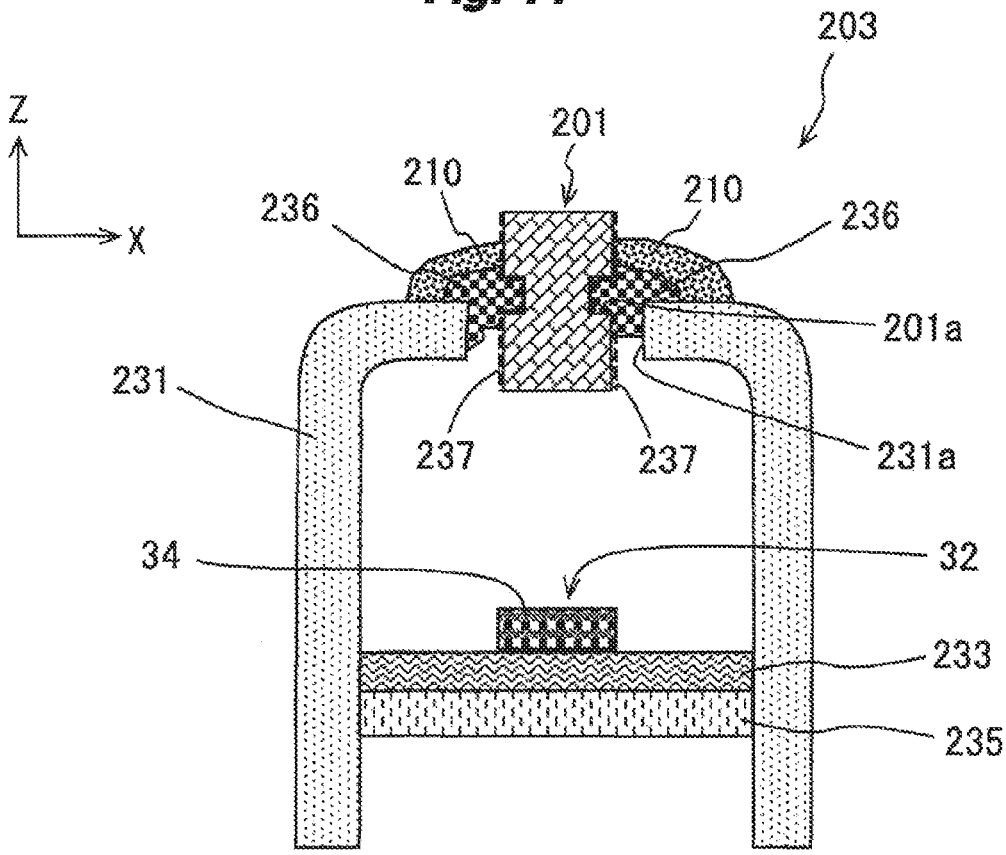
FIG. 11 is a cross-sectional view of E-E in the plan view in FIG. 10, which is a cross section of a plane perpendicular to the longitudinal direction (arrow Y direction) of the LED head in Embodiment 3.
Figure 12:
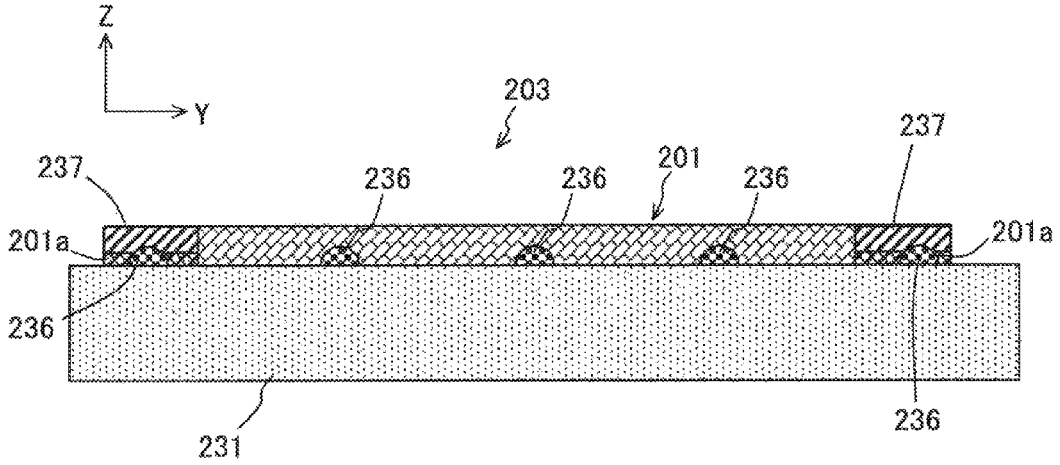
FIG. 12 is a side view of the LED head shown in FIG. 11 from the positive side of the arrow X direction.

FIG. 10 is a plan view showing the configuration of a LED head 203 of Embodiment 3 based on this invention, FIG. 11 is a cross-sectional view of E-E in the plan view in FIG. 10, which is a plane perpendicular to the longitudinal direction (arrow Y direction) of the LED head 203, and FIG. 12 is a side view of the LED head 203 shown in FIG. 11 from the positive side of the arrow X direction. Note that in FIGS. 10 and 12 a sealing member 210 shown in FIG. 11 is omitted for the sake of convenience.

The difference of an image forming apparatus of this embodiment adopting this LED head 203 from the color printer 90 (FIG. 1) of Embodiment 1 mentioned above is the method of attaching a lens array 201 in the LED head 203. Therefore, parts that the image forming apparatus adopting this LED head 203 has in common with the color printer 90 (FIG. 1) of Embodiment 1 mentioned above are given the same codes, or their figures and explanations are omitted, and the differences are mainly explained. Note that because the main part configuration of the image forming apparatus of this embodiment is common with the main part configuration of the color printer 90 of Embodiment 1 shown in FIG. 1, figures in Embodiment 1 are referred to as necessary.

As shown in FIGS. 10-12, the LED head 203 as an exposure device is provided with the lens array 201 as an optical system member, a holder 231 as an optical system support part, and an LED array 32 as a light emitting element array, where the holder 231 holds the lens array 201 and the LED array 32 in the same positional relation as the LED head 3 in Embodiment 1 mentioned above.

Figure 13:
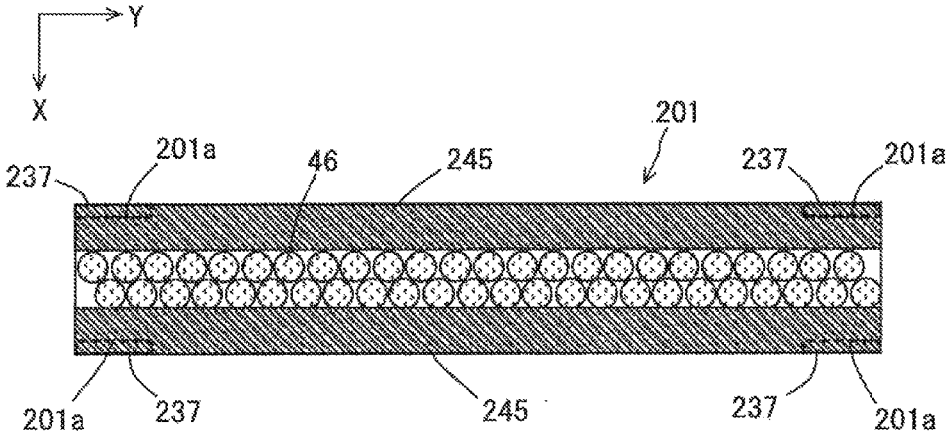
FIG. 13 is a plan view of a lens array in Embodiment 3 from the positive side of the arrow Z direction.

FIG. 13 is a plan view of the lens array 201 from the positive side of the arrow Z direction. As shown in FIG. 13, the lens array 201 comprises a pair of side plates 245 that are made of paper phenolic resin plates for example and disposed opposing each other, and multiple rod lenses 46 disposed between the pair of side plates 245. The multiple rod lenses 46 that are distributed-index lenses are disposed in two rows, and further disposed so that the rod lenses 46 in the different rows are positioned alternately in the longitudinal direction (arrow Y direction here).

Also, spaces between the rod lenses 46 and spaces between the side plates 245 and the rod lenses 46 are formed by filling and curing an adhesive made of a silicon resin for example, and disposed so that the optical axes of the rod lenses 46 become the arrow Z direction (the vertical direction in the figure).

Because the holder 231 holds this lens array 201 opposing a photosensitive drum 41 (FIG. 3), it is provided with an opening part 231*a* that is formed on its upper face, extends in parallel to the longitudinal direction, and has the lens array 201 fit loosely with it, and holds the lens array 201 in a state of being fitted in by gluing it at multiple gluing places with the adhesive 236 as the restraining members. A substrate 233 where LED elements 34 are arranged is fixed to the holder 231 by a base member 235 so that the LED array 32 of the LED elements 34 arranged in a line opposes the lens array 201 inside the holder 231.

Figure 14:
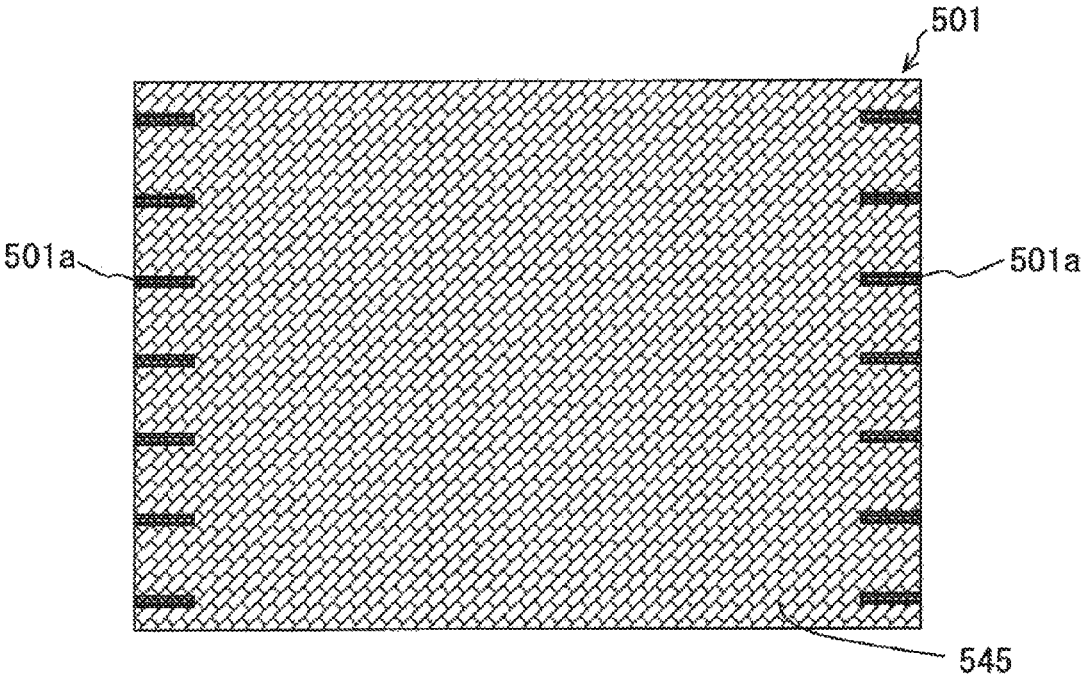
FIG. 14 is a diagram for explaining the formation process of the lens array in Embodiment 3.
Figure 15:
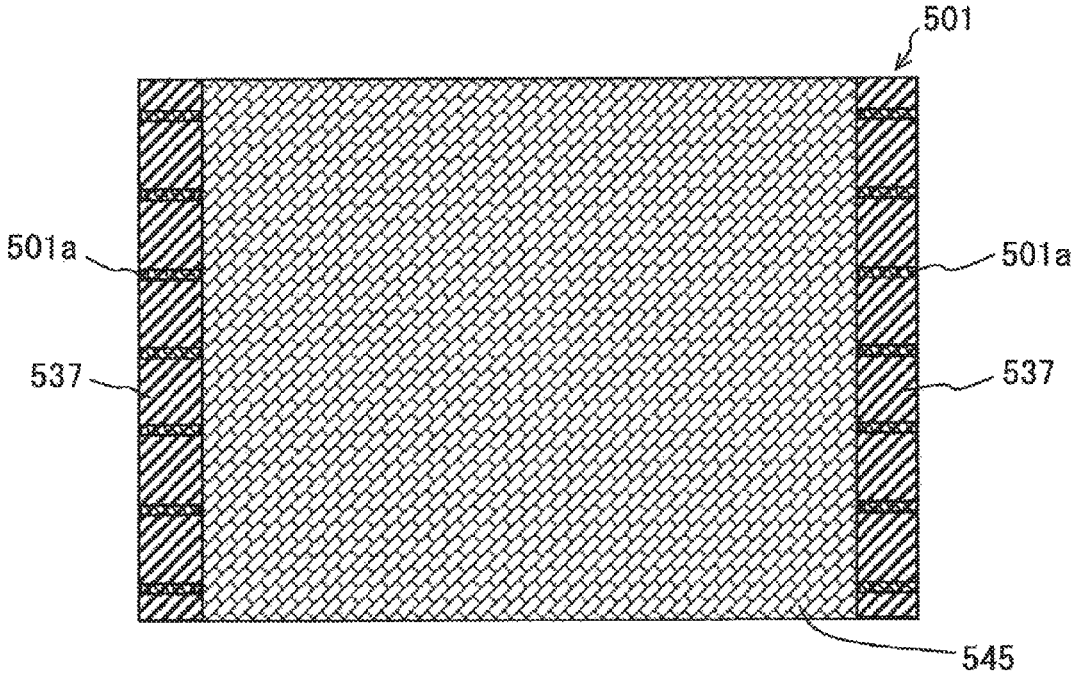
FIG. 15 is a diagram for explaining the formation process of the lens array in Embodiment 3.
Figure 16:
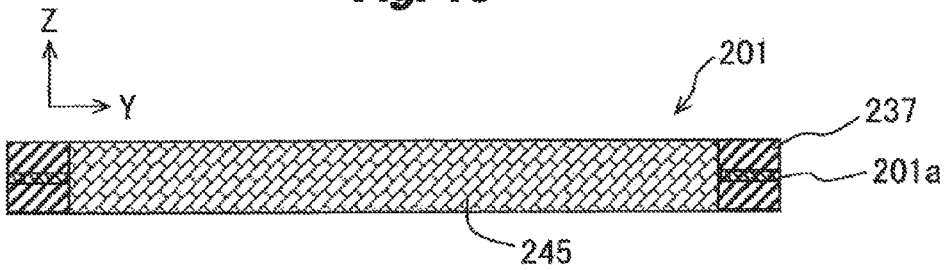
FIG. 16 is a diagram for explaining the formation process of the lens array in Embodiment 3.

FIGS. 14-16 are explanatory diagrams for explaining the formation process of the lens array 201. For the lens array 201, as shown in FIG. 14 for example, on an original board 501 before divided into the individual lens arrays 201, grooves 501*a* (corresponding to grooves 201*a* after division) that are parallel to the longitudinal direction are formed in the vicinity of the longitudinal ends of both side plates 545 (corresponding to the side plates 245 after division) using an end mill or the like.

These multiple grooves 501*a* are formed in the optical axis direction of the rod lenses 46 (FIG. 13) with intervals corresponding to the height of the lens array 201, and the depth of each groove is 0.5 mm for example, and the width is 1 mm for example. The depth of the grooves is set shallower than the thickness of the side plates 545 so that they are formed on the side plates 545.

Then, as shown in FIG. 15, on both end parts including regions where the grooves 501*a* are formed in the longitudinal direction, formed are sliding parts 537 (corresponding to sliding parts 237 after division) to which applied is a chemical agent, such as a silicon coating agent, that worsens adhesion with an adhesive 236 using a slit coater. Afterwards, as shown in FIG. 16, it is divided into the individual lens arrays 201.

Note that although it was assumed here that the silicon coating agent was applied to the sliding parts 237, a fluorine-based coating agent may do. Also, although the slit coater was used for applying the chemical agent, the application may be performed by dipping only the surroundings of the target parts.

As shown in FIG. 11, the adhesive 236 is formed in pairs in opposing positions on both side parts of the lens array 201, and further as shown in FIG. 10, formed in five pairs here with approximately equal intervals in the longitudinal direction of the lens array 201. Among these, the glued positions on both end parts in the longitudinal direction of the lens array 201 are set in the vicinity of the end parts, and formed in these glued positions on both end parts are the grooves 201*a* that are parallel to the longitudinal direction and the sliding parts 237 as mentioned above. Note that the grooves 201*a* as engagement parts and the sliding parts 237 as sliding regions are formed on the side plates 245 (FIG. 13) of the lens array 201 as mentioned above.

The E-E cross-sectional view in FIG. 11 is a cross-sectional view in a position where these grooves 201*a* and the sliding parts 237 are formed, and as shown in FIGS. 10-12, the adhesive 236 in this part is formed continuously over the regions of the upper face (arrow Z positive-side face) of a flat plate where the opening part 231*a* is formed, the side face of the opening part 231*a*, and the grooves 201*a* where the sliding parts 237 are formed. Note that although the grooves 201*a* and the sliding parts 237 are not formed in the other glued positions than the both end parts of the lens array 201, the adhesive 236 is formed in the same manner between the holder 231 and the lens array 201.

Therefore, in the glued positions on both end parts of the lens array 201, although the adhesive 236 cures in a shape conforming to the grooves 201*a* and their surroundings, the adhesive power between the adhesive 236 and the lens array 201 is either very small, or they are not bonded.

Further, in order to prevent light and foreign bodies from flowing onto the LED array 32 through a space occurring in the opening part 231*a* with the lens array 1, a sealing member 210 such as silicon rubber having flexibility is applied between the holder 231 and the lens array 201 so as to fill this space and further cover the adhesive 236.

Being formed in the above-mentioned manner, the adhesive 236 applied to the sliding parts 237 comes into a state where its adhesive power to the contact faces with the sliding parts 237 is weakened, and the lens array 201 becomes slidable in the longitudinal direction, although being tight, guided by the adhesive 236 that became integrated with the holder 231 and fits in its grooves 201*a*.

If the LED head 203 configured in the above-mentioned manner is left in a high temperature environment for example, due to the difference in the thermal expansion coefficient between the holder 231 and the lens array 201, a thermal stress occurs to the adhesive 236 that bonds them. At this time, its influence is great in the glued positions on both side parts of the lens array 201, and the lens array 201 tries to move in the longitudinal direction relative to the holder 231.

On these both end parts, because the grooves 201*a* and the sliding parts 237 are formed in the glued positions of the lens array 201 to make the lens array 201 slidable in the longitudinal direction relative to the holder 231 as mentioned above, this movement by heat is allowed. Therefore, the adhesive 236 on these parts cannot be destroyed by a thermal stress, and its bonding with the holder 231 cannot peel off.

Also, on these both end parts, because the adhesive 236 fits in the grooves 201*a* of the lens array 201, as mentioned above, the lens array 201 becomes movable only in the longitudinal direction that is the extending direction of the grooves, guided by the adhesive 236 integrated with the holder 231, and cannot move in any other direction than the longitudinal direction.

Conversely, when left in a low-temperature environment, the both end parts of the lens array 201 move in the opposite direction from that when left in a high-temperature environment mentioned above. Because this movement is allowed in the same manner, the adhesive 236 on these parts cannot be destroyed by a thermal stress.

Note that for the holder 231, the side plates 245 of the lens array 201, the adhesive 236, the sliding parts 237, etc. in this embodiment, the materials explained in Embodiment 1 mentioned above can be adopted.

Also, although the grooves 201*a* parallel to the longitudinal direction of the lens array 201 were formed as engagement parts in this embodiment, projection parts extending in the same direction, for example, can substitute for the grooves.

As stated above, according to the LED head 203 of this embodiment, even if the lens array 201 and the holder 231 having greatly different coefficients of thermal expansion are used, there occurs no irreversible changes such as destruction due to the influence of a thermal stress of the adhesive 236 on the gluing places on the lens array end parts, which maintains holding and fixing of the lens array 201 in any other direction than the longitudinal direction of the LED head 203 by the holder 231.

Embodiment 4

Figure 17:
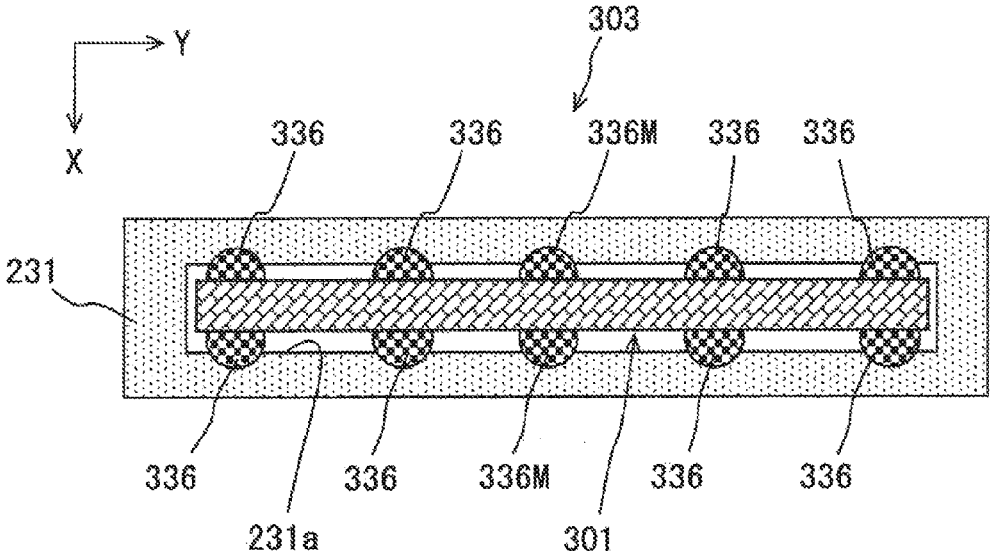
FIG. 17 is a plan view showing the configuration of an LED head of Embodiment 4 based on this invention.
Figure 18:
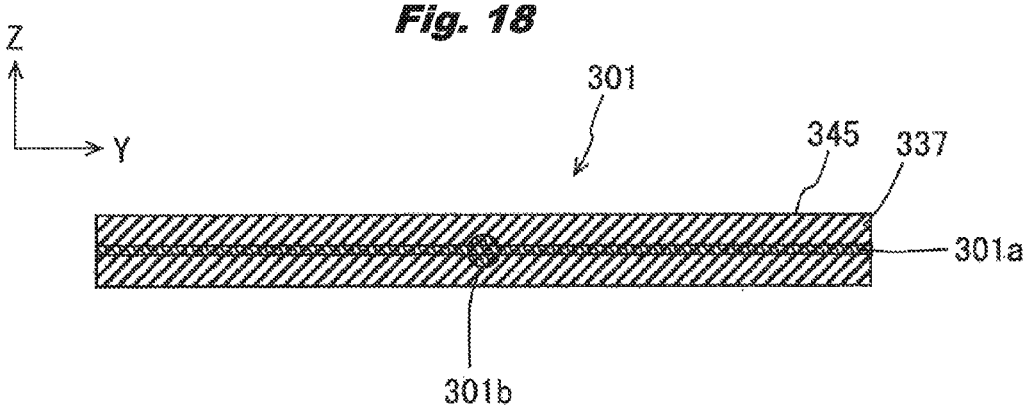
FIG. 18 is a side view of a lens array of Embodiment 4.

FIG. 17 is a plan view showing the configuration of an LED head 303 of Embodiment 4 based on this invention, and FIG. 18 is a side view of a lens array 301 of this embodiment.

The main difference of this LED head 303 from the LED head 203 of Embodiment 3 mentioned above is the configuration of side plates 345 (corresponding to the side plates 245 in FIG. 16) of the lens array 301. Therefore, parts that an image forming apparatus adopting this LED head 303 has in common with the LED head 203 of Embodiment 3 mentioned above are given the same codes, or their drawings and explanations are omitted, and the differences are mainly explained.

Figure 19:
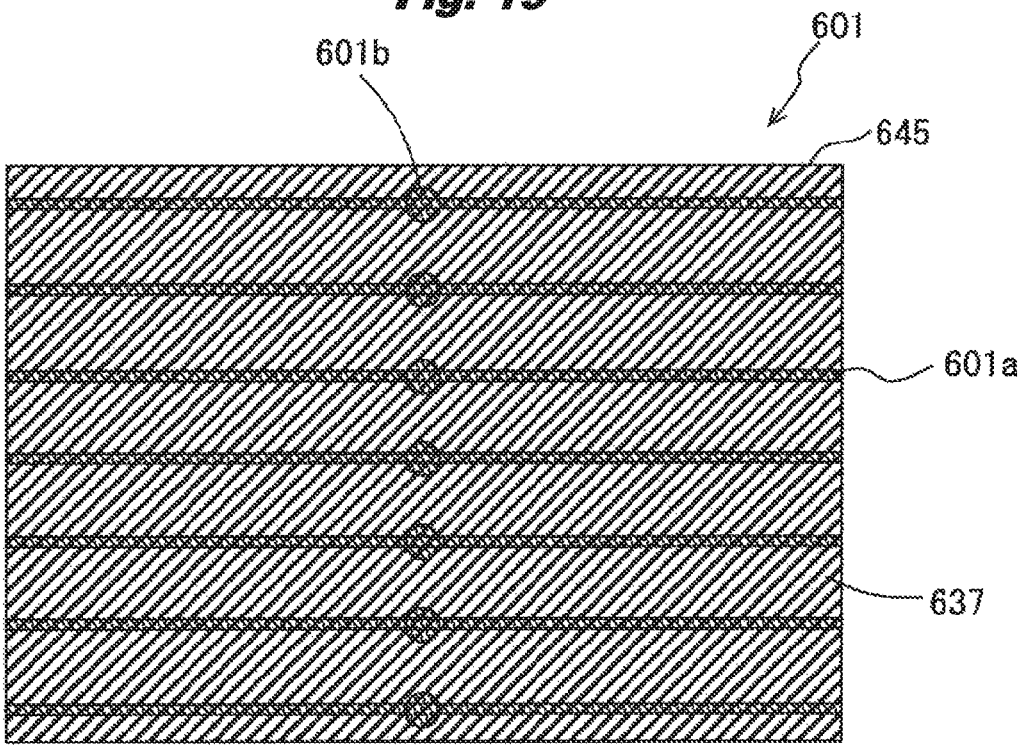
FIG. 19 is a diagram for explaining the formation process of the lens array in Embodiment 4.

FIG. 19 is an explanatory diagram for explaining the formation process of the lens array 301. On an original board 601 before divided into the individual lens arrays 301, grooves 601*a* (corresponding to grooves 301*a* after division) are formed over the entire region in the longitudinal direction of both side plates 645 (corresponding to the side plates 345 after division) using an end mill or the like. These multiple grooves 601*a* are formed in the optical axis direction of rod lenses 46 (FIG. 13) with intervals corresponding to the height of the lens array 301, where the depth of each groove is 0.5 mm for example, and the width is 1 mm for example.

Formed on the central part in the longitudinal direction of each groove 601*a* is a circular groove 601*b* (corresponding to a circular groove 301*b* after division) having a larger diameter ϕ (ϕ=1.5 mm here) than the width of the grooves 601*a* (1 mm here) and a depth of 0.5 mm. The depths of the grooves 601*a* and the circular grooves 601*b* are set shallower than the thickness of the side plates so as to be formed on the side plates 645.

Afterwards, formed over the entire faces of the side plates 645 are sliding parts 637 (corresponding to sliding parts 337 after division) to which applied is a chemical agent such as a silicon coating agent that worsens adhesion with an adhesive 336 using a slit coater. Afterwards, as shown in FIG. 18, it is divided into the individual lens arrays 301.

Note that although the silicon coating agent was applied to the sliding parts 637, a fluorine-based coating agent may do. Also, although the slit coater was used for applying the chemical agent, dipping may be used for the application.

As shown in FIG. 17, the adhesive 336 is formed in pairs in opposing positions on both side parts of the lens array 301, and five pairs are formed here with approximately equal intervals in the longitudinal direction of the lens array 301. Here, the grooves 301*a* are formed over the entire region in the longitudinal direction of the side plates 345, and the sliding parts 337 are formed over the entire faces of the side plates 345. Therefore, the relation of the holder 231, the lens array 301, and the adhesive 336 in each glued position is the same as their relation in the glued position on the both end parts of the lens array 201 explained referring to FIGS. 10-12 in Embodiment 3 mentioned above, and thus their detailed explanations are omitted here.

However, in the glued position to which an adhesive 336M on the central part is applied, because the circular groove 301*b* as a lock part is formed in the corresponding position of the lens array 301, the adhesive 336M applied to the region covering this circular groove 301*b* is filled into the circular groove 301*b* and cures. Therefore, in this central part, the movement of the lens array 301 relative to the holder 231 is restricted in all directions including the longitudinal direction. In the other glued positions, as mentioned above, the lens array 201 is slidable only in the longitudinal direction relative to the holder 231.

According to the LED head 303 having the above-mentioned configuration, if a difference in the thermal expansion coefficient between the holder 331 and the lens array 301 causes a relative position shift in the longitudinal direction of the LED head 303 depending on the temperature environment, in the glued position of the adhesive 336M on the central part, the relative position in the same direction is fixed, and in the other glued positions where sliding is allowed, sliding occurs according to the shift.

Note that although the circular groove 301*b* was formed as the lock part on the central part in the longitudinal direction of the lens array 301 in this embodiment, this invention is not limited to this, but a polygonal groove may do for example. Also, it is possible to make the depth of the groove different from other groove parts or a projection part substitute for the groove. Further, the lock part is not limited to be on the central part but may be formed on other parts than the central part and may be formed on multiple places.

As stated above, according to the LED head 303 of this embodiment, in addition to the effects of Embodiment 3 mentioned above, a specified part in the longitudinal direction of the lens array 301 is firmly held by the holder 231, and the lens array 301 as a whole does not move in the longitudinal direction relative to the holder 231, therefore accuracy as the LED head 303 is not damaged due to environmental changes, passing of time, etc. Also, because it becomes possible to apply a chemical liquid to the entire faces of the lens side plates, the application and drying processes of the chemical liquid can be simplified.

Although explanations in the above-mentioned embodiments were given using examples of applications to electrophotographic color printers, this invention is not limited to those but can be applied to facsimile machines, copiers, MFPs (MultiFunction Peripherals), and even scanners and the like as reading devices.

What is claimed is:

1. An exposure device comprising:

an optical system member that forms an image of light from a light emitting element array having multiple light emitting elements arranged, an optical system support part that supports the optical system member, and an adhesive fixed on the optical system member when the adhesive is cured, wherein in a center part of the optical system member in a longitudinal direction thereof, the adhesive is cured to fix the adhesive and the optical system support part such that the optical system member is fixed to the optical system support part, and in the both end parts or in the vicinity of the both end parts in the longitudinal direction of the optical system member, the adhesive is cured with a less adhesive power between the adhesive and the optical system support part than the adhesive in the center part so that the optical system member is slidable relative to the optical system support part.

2. The exposure device according to claim 1, wherein in the both end parts or in the vicinity of the both end parts in the longitudinal direction of the optical system member, the adhesive is cured with a lubricating oil of high releasability being applied thereto.

3. The exposure device according to claim 1, wherein in the both end parts or in the vicinity of the both end parts in the longitudinal direction of the optical system member, the adhesive is cured with a film of high releasability coating the optical system support part.

4. The exposure device according to claim 1, wherein in the both end parts or in the vicinity of the both end parts in the longitudinal direction of the optical system member, the adhesive is cured with a film of high releasability being pasted on the optical system support part.

5. The exposure device according to claim 1, wherein the optical system support part has a lock part formed on a central part in the longitudinal direction, and the adhesive is formed in a space with the optical system member so as to cover the lock part and fixes the optical system member to the optical system support part.

6. The exposure device according to claim 5, wherein the lock part is a protruding part provided with a face that is perpendicular or oblique to the longitudinal direction.

7. The exposure device according to claim 5, wherein the lock part is configured in recess and projection shapes.

8. The exposure device according to claim 1, wherein the light emitting elements are LEDs.

9. The exposure device according to claim 1, wherein the adhesive is a UV adhesive.

10. The exposure device according to claim 9, wherein the UV adhesive contains a glass filler.

11. The exposure device according to claim 1, wherein the optical system member is a lens array.

12. An image forming apparatus provided with the exposure device according to claim 1.

13. An exposure device comprising:

an optical system member that forms an image of light from a light emitting element array in which multiple light emitting elements are arranged, an optical system support part that supports the optical system member, and an adhesive that is fixed to the optical system support part when the adhesive is cured, wherein the optical system member are provided with engagement parts extending in a longitudinal direction on both end parts or the vicinity of the both end parts in the longitudinal direction, in a center part of the optical system member in the longitudinal direction thereof, the adhesive is cured to fix the adhesive and the optical system support part such that the optical system member is fixed to the optical system support part, and in the both end parts or in the vicinity of the both end parts in the longitudinal direction of the optical system member, the adhesive is cured with a less adhesive power between the adhesive and the engagement pans than the adhesive between the optical system member and the optical system support part in the center part so that the optical system member is slidable relative to the optical system support part.

14. The exposure device according to claim 13, wherein the engagement parts are grooves.

15. The exposure device according to claim 14, wherein the grooves are formed over an entire region of the optical system member in the longitudinal direction, a lock part is formed on a part of the grooves on the central part in the longitudinal direction, and the adhesive is formed to fix the optical system member to the optical system support part so as to cover the lock parts.

16. The exposure device according to claim 15, wherein the lock parts are circular or polygonal grooves having a larger width than the width of the grooves.

17. The exposure device according to claim 13, wherein the light emitting elements are LEDs.

18. An image forming apparatus provided with the exposure device according to claim 13.

19. An exposure device comprising:

an optical system member that forms an image of light from a light emitting element array in which multiple light emitting elements are arranged, an optical system support pan that supports the optical system member, and a restraining member that restrains the optical system member to the optical system support part, wherein the optical system member are provided with engagement parts extending in the longitudinal direction on both end parts or the vicinity of the both end parts in the longitudinal direction, and sliding parts that allow the engagement parts to slide relative to the restraining member in regions including the engagement parts, in the both end parts or in the vicinity of the both end parts in the longitudinal direction, the restraining member is formed between the optical s stem support part and the engagement parts, fixed to the optical system support part, and slidable in the longitudinal direction relative to the optical system member, and the sliding parts are formed by applying a chemical agent that worsens adhesion with the restraining member.

* * * * *